US005204208A

United States Patent [19]

Paine et al.

[11] Patent Number: 5,204,208

[45] Date of Patent: Apr. 20, 1993

[54] PROCESSES FOR CUSTOM COLOR ENCAPSULATED TONER COMPOSITIONS

[75] Inventors: Anthony J. Paine, Mississauga; Trevor I. Martin, Burlington; Lurdes M. Martins, Mississauga; Karen A. Moffat, Brantford; Walter Mychajlowskij, Georgetown, all of Canada

[73] Assignee: Xerox Corporation, Stamford, Conn.

[21] Appl. No.: 772,307

[22] Filed: Oct. 7, 1991

[51] Int. Cl.[5] ..... G03G 9/093

[52] U.S. Cl. ..... 430/137; 430/138

[58] Field of Search ..... 430/45, 137, 138

[56] References Cited

U.S. PATENT DOCUMENTS

| | | | |
|---|---|---|---|
| 3,830,750 | 8/1974 | Wellman . | |
| 3,870,644 | 3/1975 | Machida et al. . | |
| 3,893,932 | 7/1975 | Azar et al. . | |
| 4,066,563 | 1/1978 | Mammino et al. . | |
| 4,070,296 | 1/1978 | Gibson et al. | 427/20 |
| 4,590,139 | 5/1986 | Imai et al. | 430/45 |
| 4,656,111 | 4/1987 | Wakamiya et al. | 430/109 |
| 4,908,301 | 3/1990 | Grosso et al. | 430/45 |
| 4,937,167 | 6/1990 | Moffat et al. | 430/137 |

FOREIGN PATENT DOCUMENTS

| | | | |
|---|---|---|---|
| 83546 | 4/1986 | Japan | 430/45 |

*Primary Examiner*—Roland Martin

*Attorney, Agent, or Firm*—Eugene O. Palazzo; Zosan S. Soong

[57] ABSTRACT

A process for obtaining custom color toner compositions which comprises admixing at least two encapsulated toners wherein each toner is comprised of a core comprised of a polymer binder, pigment, dye, or mixtures thereof, and a polymeric shell; and wherein the pigment, dye, or mixtures thereof is different for each toner, thereby resulting in a toner with a color different than each of said encapsulated toners.

32 Claims, No Drawings

PROCESSES FOR CUSTOM COLOR ENCAPSULATED TONER COMPOSITIONS

BACKGROUND OF THE INVENTION

The present invention is generally directed to encapsulated toners and developers, and processes thereof, including for example a process for the preparation of custom and highlight colored toners. More specifically, the present invention in one embodiment is directed to a process for obtaining custom and highlight color toners by blending two or more encapsulated toners encompassed within a primary set of color encapsulated toners, and wherein the primary color encapsulated toners can be prepared by providing a polymeric core material containing a different primary pigment colorant and encapsulating the pigment colorant within each toner with a polymeric shell. In another embodiment, the present invention relates to processes for obtaining custom color toners comprised of a mixture of at least two passivated encapsulated toner compositions comprised, for example, of a core comprised of a polymer binder and colorants, including pigments, dyes, or mixtures thereof, and a polymeric shell thereover prepared, for example, by interfacial polymerization, and wherein the pigment, dye, or mixture in the encapsulated toners are comprised of different or dissimilar components, for example the first encapsulated toner may contain a cyan pigment, and the second encapsulated toner may contain a magenta pigment enabling a blue toner when the aforementioned toners are blended. Another embodiment of the present invention relates to processes for colored passivated toners comprised of a mixture of at least two encapsulated toners, wherein the core contains pigments such as cyan, magenta, yellow, red, blue, green, brown, black, white or mixtures thereof, and wherein the pigments in each toner are comprised of a different component, for example with two encapsulated toners the first pigment, which is passivated can be comprised of a cyan component, and the second pigment, which is passivated, can be comprised of a yellow pigment to enable a custom green encapsulated toner subsequent to mixing. Similarly, a mixture of a cyan encapsulated toner and a magenta encapsulated toner will enable a bluish encapsulated toner; and a mixture of a magenta and yellow encapsulated toner will enable a yellow encapsulated toner. In another embodiment of the present invention, there are provided processes for custom colored toners comprised of a first encapsulated toner and a second encapsulated toner, and wherein the aforementioned toners may possess the same or similar triboelectric characteristics and the same or similar admix properties, that is the toners are passivated in that, for example, the core pigments do not adversely affect the triboelectric characteristics thereof, and the tribo charge of the toners is independent of the core pigments selected. Toners with similar triboelectric and admix characteristics are of value in that, for example, the xerographic properties of only one color toner needs optimization instead of the usual 4 to 7 (for example, black, cyan, magenta, yellow, red, blue, brown, and the like); the toners can be selected for known highlight, trilevel imaging processes, and custom color processes; enabling color image stability in electrophotographic, especially xerographic, imaging apparatuses employing custom color processes, greatly expanding the number of custom color toners that can be prepared.

Several other advantages are associated with the present invention, including for the product desirable heat fusibility, triboelectric passivation of the components, especially the pigment components present in the core thereby avoiding or minimizing the electrical, especially the triboelectrical, degradation properties of the resulting toner caused by the pigment particles; narrow size distribution of the particles (GSD) of, for example, from 1.3 to about 1.7; stable shell characteristics; blocking temperatures, for example in an embodiment of the present invention blocking temperatures for the heat fusible toners, especially with polyurea shells, of greater than 80° C.; avoidance or minimization of particle agglomeration and coalescence, especially at elevated core polymerization temperatures; excellent melt flow properties, for example, from about 10° to about 50° C. lower than a toner comprised of styrene n-butylmethacrylate, 88 weight percent, 10 weight percent of carbon black, and 2 weight percent of cetyl pyridinium chloride as a charge enhancing additive, and the like.

Toners suitable for use in electrophotographic apparatuses, including printers, may include therein a wide variety of colors, such as black, red, green, blue, brown, yellow, purple, silver and gold. When it is desired to highlight certain features of a document, one or more colored toners are typically used in conjunction with a black toner to provide an image in two or more colors. Full color images can also be generated by developing images with cyan, magenta, yellow and, optionally, black toners. Generally, it is advantageous for such toners to exhibit low melting temperatures to enable low energy fusing of the developed images to substrates at lower temperatures and lower pressures of 50 to 400 psi versus 4,000 psi for many prior art cold pressure fixable applications. It is also often advantageous for such toners to possess mean particle diameters of from about 2 microns to about 30 microns and preferably from about 2 microns to about 15 microns to enable images of high resolution, low image noise and high color fidelity. Further, it is generally desirable for these small diameter toners to possess narrow size distributions, preferably with a GSD (Geometric Standard Deviation) of 1.3 or less, to avoid difficulties in the electrophotographic development and transfer associated with oversize toner particles and extremely fine toner particles. These and other advantages can be achieved with the encapsulated toners and processes of the present invention in embodiments thereof.

The toner compositions of the present invention can be selected for a variety of known imaging and printing processes including electrophotographic processes. Specifically, the toner compositions of the present invention can be selected for xerographic imaging and printing processes including color processes, such as two component development systems and single component development systems, including both magnetic and nonmagnetic; and ionographic processes wherein dielectric receivers such as silicon carbide are utilized, reference U.S. Pat. No. 4,885,220, the disclosure of which is totally incorporated herein by reference.

With regard to embodiments of the present invention reference to the following is mentioned:

Triboelectric Passivation: When the xerographic properties such as triboelectric charge (tribo), admix, developer stability, humidity sensitivity, and the like of the highlight color and black toners are substantially equivalent, the toners can be considered triboelectrically passivated. One primary main advantage of a blended mixture of two passivated encapsulated toners is their interchangeability.

Highlight Color: A highlight color toner can be a single toner, of a single color of a usually saturated hue, which is employed with a second color toner, most commonly black toner. Such color toners may be imaged on documents with twin engine xerographic copiers or printers, where each engine comprises a separate charging, exposure, development, transfer, and cleaning step, one for each color toner, or with single engine xerographic copiers or printers which utilize two separate development stations, one for each color, and where the paper or transparency, or other throughput substrate makes either one or two cycles. An example of a single engine printing/copying device with only one cycle can be referred to as known trilevel xerography. Applications of highlight color include, for example, emphasizing important information, headlining titles in documents, slides, overhead transparencies, figures and the like. The image color density of a highlight color is controlled by the developed toner mass per unit area, for example the higher the toner mass per unit area, the darker the color. Typical highlight colors are common colors desired by many different types of customers, such as red, blue, brown, green, and the like.

Functional Color Toners: Highlight colors are not necessarily limited to black plus one color, but may also include black plus two colors or black plus 3 or more highlight colors. Black plus several colors, usually accomplished with multiple xerographic engines, can also be referred to as functional color, and might be employed, for example, in cartoon pictures, instruction manuals, utility bills, and the like. Functional colors are not usually mixed in the image, and are usually saturated.

Pictorial Color: Pictorial color refers to black plus 3 subtractive primary colors (cyan, magenta, and yellow), where the color toners are applied in successive layers, with continuous, or near continuous density, or developed toner mass to span as wide a color gamut as possible.

Custom Color Toner: A custom color toner is a very specific highlight color toner. Often toners with these colors are used for corporate logos and letterhead, or government flags, or official document seals, where the color coordinates are specified. Examples of custom colors are Xerox Corporation® Blue, IBM® Blue, Blue Cross® Blue, and the like. Other custom colors might include gold, silver, fluorescent colors, and the like.

Security Toners: Security toners are specific custom color toners created with either special ingredients which can be detected to authenticate documents (for example, infrared absorbing or fluorescing or radioactive or magnetic components), or special ingredients which prevent copying (for example, fluorescent materials which emit sufficient light when illuminated in typical copiers to discharge the photorecptor and blank out the encoded information). Like other custom color toners, these materials might be very specific to the end user, and might vary from customer to customer, or from application to application.

Known color toners fall into two different broad categories, conventional and encapsulated. Conventional color toners can be comprised of pigmented or dyed resin particles, while encapsulated toners are comprised of a pigmented or dyed resin core, and a protective shell overcoat. The conventional toners are most commonly prepared by an extended and involved process of compounding the pigment and optional additives with the resin, jetting of this material into toner sized particles, and classification of the toner. Since the cleaning of the blenders, extruders, and jetting mills between different color batches is labor intensive and expensive, this process may best be suited to the manufacture of medium to very large quantities of toner in batches larger than 1,000 kilograms, for example. Therefore, it is likely that this process is only economically feasible for those colors for which there is an aggregate demand of greater than several thousand kilograms of toner per year. Such conventional color toners are usually characterized by triboelectric and admix properties which vary from one color to another because of the well known and often very large effect of the pigment on the electroscopic properties. As a consequence of these variations in triboelectric properties from one color toner to another, each color toner usually requires an exhaustive research and development effort to obtain desirable triboelectric characteristics compatible with other colors in the set. Normally such research and development efforts for a pictorial color set (black plus cyan, magenta, and yellow) can consume four times as much time as the research and development optimization of a single black toner. Thus, the known conventional toner manufacturing approach is economically feasible for popular highlight colors, such as red, green, brown and blue. However, these processes can become prohibitively expensive for most custom colors. To offset the high cost of small batches of custom color toners, moderately large batches would have to be formulated and substantial inventories of different colored toner material maintained. These and other disadvantages are avoided or minimized with the toners and processes of the present invention.

The blending of conventional toners is known, reference for example U.S. Pat. Nos. 4,395,471 and 4,312,932. However, the extremely high research and development cost for optimization of the xerographic properties of blended conventional toners is still present, and inhibits application to custom color in the same way as unblended conventional toners.

An advantage of encapsulated toners, reference U.S. Pat. No. 4,937,167 and copending patent application U.S. Ser. No. 516,864, the disclosures of which are totally incorporated herein by reference, are that once the optimized xerographic and electroscopic properties of one color toner are obtained, the same properties are evident for the other colors. This dramatically shortens the research and development time to optimize a set of colored toners, for example, to perhaps 1.5 times as long for the pictorial four color set (cyan, magenta, yellow and black) compared to a single black toner. Therefore, the final cost of the color toners can be lower. Furthermore, it is much easier to introduce new colors using passivated encapsulated toners than using conventional melt blended and jetted toners because the new encapsulated toner will have the same tribo properties as the others in the set, while the new conventional toner will have different tribo properties, and can require another long and involved reserach and development cycle to optimize its electroscopic properties.

A number of encapsulated toners have disadvantages with regard to low volume highlight color processes, especially custom color toners, since for example (a) low volume production of, for example, only several kilograms is prohibitively expensive because the labor cost and complex reactor and overhead cost component of the synthesis is relatively large and the labor cost is independent of the batch size; (b) making custom colors by, for example, blending two or more cyan, magenta, yellow or other pigments in the toner formulation may give rise to unexpected effects, including (i) some variation in the particle size due to core viscosity differences, (ii) specific and undesirable interactions of new pigments with shell monomer components, (iii) specific and undesirable interactions between the mixed pigments which might lead to pigment agglomeration, a poor pigment dispersion, and poor color quality, (iv) obtaining a color unlike the target color, and other problems leading to unacceptable material or the like. These and other disadvantages can be avoided or minimized with the toners and processes of the present invention wherein, for example, there is accomplished the blending of passivated encapsulated color toners.

In a patentability search report, the following U.S. patents were recited, the disclosures of each of these patents being totally incorporated herein by reference, U.S. Pat. No. 4,937,167 which discloses the preparation of two encapsulated toner compositions of different colors and with similar triboelectric charging characteristics by a polymerization method and wherein for the first toner there is selected a pigment with a different color than the pigment for the second toner; U.S. Pat. Nos. 3,830,750; 3,893,932; 4,656,111 and as collateral interest U.S. Pat. Nos. 3,870,644; 4,066,563 and 4,070,296.

In one aspect, the present invention relates to the preparation of blendable passivated color toners, referred to as the primary set, which primary set could be economically manufactured in large volume batches, for example, of greater than 2,000 kilograms. Typical primary sets would include, as a minimum, one cyan toner, one magenta toner, and one yellow toner. Optional toners which could be included in a primary set are black, white, unpigmented, fluorescent, gold, silver, IR absorbing, metallic, and the like, which permit the possibility of added desirable effects to a variety of other color toners when blended with other toners in the primary set. One primary embodiment of the invention relates to the preparation of highlight color toners such as red, blue, green, brown, orange, and the like by blending two or more encapsulated toners from the primary set. For example, a variety of shades of red encapsulated toners can be generated by blending magenta and yellow primary toners in a variety of ratios, for example, from about 60 parts of a yellow encapsulated toner blended with about 40 parts of a magenta encapsulated to about 10 parts of yellow blended with 90 parts of magenta, with the optional addition of white, unpigmented, fluorescent or gold primary color toners for special effects. In another embodiment, a variety of shades of blue custom color toners, for example, for the logos of different companies can be obtained by blending magenta and cyan primary toners in a variety of ratios, for example, from about 25 parts of cyan blended with 75 parts of magenta to about 90 parts of cyan blended with 10 parts of magenta with optional addition of white, unpigmented, or black or fluorescent primary toners, for example in amounts of from about 1 part to about 200 parts by weight.

One advantage of blending passivated encapsulated toners from the primary set is that if the color of the blended toner is not correct, further addition of one or other original primary toner, or of a third primary toner to the original blend can be employed to achieve the target color properties without wastage of the first blended material, whereas prior art direct synthesis of a single color toner, which was off-specification, would be unusable, and the toner would likely have to be discarded. Another specific advantage of the present invention is that there are substantially no variations in particle size caused during synthesis by pigment variation because the primary set toners to be blended can be prepared in advance. Furthermore, since the number of primary toners in the set is relatively small, fewer synthetic optimizations are required than would be the situation with the prior art. Also, another advantage of the present invention is that the blended toner pigments cannot agglomerate with one another, as they might within a single toner, because they are isolated in separate toner particles in the primary set of toners. Other examples of advantages of the the present invention include small batches of highlight or custom color toners can be blended from the primary set at very low cost. This would permit a more rapid response to customer needs as they arose.

Other advantages include the primary toner synthesis steps could be perfomed on an economically large scale to provide, for example, blendable cyan, magenta, and yellow toners, such materials being of lower cost as they can be manufactured on a large scale; no need for xerographic optimization of each blended toner as it was prepared since the encapsulation process provides triboelectrically passivated toners, the blended color toners have the same triboelectric properties as any other color toner made from the same primary set of blendable toners, and the same triboelectric properties as the primary set itself. The blended encapsulated toners provided could thus be immediate "drop in" replacements for printers or xerographic imaging apparatus without the need for costly qualification processes to determine their performance.

A further advantage of the present invention resides in the range and number of economically feasible highlight or custom color toners available to customers compared to the limited range and number of economically feasible highlight or custom color toners presently available. With the present invention, an economically feasible highlight or custom color toner could be of any color in the range available from the blendable primary toners, and not limited to toners where there was an aggregate demand of several thousand kilograms. At the same time as the range and number of economically feasible color toners is expanded by the present invention, expensive toner inventory costs are minimized because only the primary blendable toners need to be stored. Toners can be blended as required for shipment. This reduces the cost to the manufacturer and to the customer, and expands the use and applicability of highlight and custom color toners.

Yet another specific advantage of the present invention is the simplification of the research and development optimization of security toners. For example, if an IR absorbing primary toner were blended with a cyan primary toner to provide an IR absorbing blended cyan custom color security toner, and this toner was imaged on documents owned by a certain customer, the origin of the documents generated could be deduced at later times from the IR absorbing characteristics of the cyan printed areas.

A further advantage of the present invention is that the same primary set of blendable toners can be maintained for pictorial color toners as well as for highlight and custom color toners. Thus, a basic inventory of only a few primary toners, for example a primary set of three color toners (cyan, magenta, and yellow) plus black, could be used for pictorial color printing and copying as well as to prepare a highlight set of blended red, blue, brown, and green toners, and to prepare blended custom color toners for a number of potential customers, and wherein optimization of only one set of triboelectric properties is needed. By contrast, using conventional toners, this would require separate preparation, and xerographic optimization of storage and maintenance of, for example, 16 toners if half of them were custom color toners.

Likewise, the addition of optional white, unpigmented, fluorescent, metallic, silver, gold or metallic toners to the primary toner set could further increase the range of potential highlight and custom colors available from blending encapsulated passivated toners.

Yet another advantage of the present invention is that encapsulation of conductive metals will yield insulating gold, silver and bronze colored toners needed for two component or single component development, whereas conventional toners with these pigments would usually be too conductive to charge or transfer properly.

A further advantage of the present invention is that encapsulated toners can be readily synthesized in small particle sizes, as small as 2 microns. This feature enables high copy quality at little or no additional cost. In contrast, conventional toners made by melt blending, extrusion, micronization and classification are characterized by rapidly increasing cost as the particle size $d_{50}$ is reduced significantly below 10 microns.

In yet another advantage of the present invention, magnetic ink character recognition (MICR) toner can be considered a custom color toner for use in the check printing or security printing business. The MICR toner could be added to the primary set and be employed as a custom highlight color on black or color documents, thus avoiding the extra expense of printing the entire document with the (usually) more expensive magnetic toner, and greatly expanding the range of copiers and printers with MICR capability.

The process of the present invention is also advantageous because all toners in a primary and blended color set can possess the same tribo and admix properties (passivation). This feature can (a) dramatically shorten color copier and printer research and development cycles since only one set of tribo and admix properties needs optimization, rather than 4 to 7; (b) enable any highlight or custom color to be use; (c) result in much more reliable color stability in copying and printing machines employing blended custom color toners; and (d) greatly increase the range of custom color toners which can be prepared from a limited inventory.

The encapsulated toner compositions selected for the present invention can also utilize a shell with substantially improved mechanical properties, and which shell does not rupture prematurely causing the core component comprised, for example, of a polymer and pigment to become exposed, and contaminating the image development subsystem surfaces or forming undesirable agglomerates. The toner compositions of the present invention can be selected for a variety of known reprographic imaging processes including electrophotographic, especially xerographic processes. Another application of the toner compositions of the present invention resides in its use for two component development systems wherein, for example, the image toning and transfer are accomplished electrostatically, and the fixing of the transferred image is achieved by application of pressure with or without the assistance of thermal energy.

The toner compositions of the present invention can, in embodiments, be prepared by a shell forming interfacial polycondensation, followed by an in situ core polymer binder forming free radical polymerization of an addition monomer or monomers initiated by thermal decomposition of a free radical initiator. In one embodiment of the present invention, the toners can be prepared by the simple and economical chemical microencapsulation method involving an interfacial polycondensation and a free radical polymerization, and wherein there are selected, for example, acrylates, methacrylates or styryl derivatives as core monomers, pigments or dyes as colorants, and polyisocyanates and amines as shell precursors to provide encapsulated toners with a polymeric shell. Further, in another process aspect of the present invention the encapsulated toners can be prepared in the absence of flammable organic solvents, thus eliminating explosion hazards associated therewith; and furthermore, these processes do not require the expensive and hazardous solvent separation and recovery steps. Moreover, with the process of the present invention there can be obtained in some instances improved yields of toner products since, for example, the extraneous solvent component can be replaced by liquid shell and core precursors.

In a patentability search report for encapsulated toners, there were recited as prior art the following U.S. patents: U.S. Pat. No. 4,830,144 directed to encapsulated pressure fixable toners with an electroconductive powder coating, reference the Abstract of the Disclosure, and the disclosure beginning in column 3, around line 48. Examples of shell components are illustrated in column 4, beginning at around line 33, and note specifically the disclosure in column 4, beginning at line 47, wherein shells are produced by the polycondensation reaction between polyisocyanates and one or more of the counterpart compounds such as polyo, polythio, polyamine, water, and perpazine can be selected; the preparation of the encapsulated toner of this patent is illustrated in column 7, beginning at line 6; examples of colorants included in the core, which colorants may comprise dyes, pigments, and the like, are illustrated beginning in column 8; surface active agents selected for the encapsulated toner of the '144 patent are illustrated in column 11, while examples of the electroconductive material include components such as antimony, halogen, and the like, reference Claim 1, for example; U.S. Pat. No. 4,721,651 directed to microcapsules of the type selected for pressure sensitive carbonless copy papers with walls formed of an aliphatic diisocyanate and a diamine and containing, for example, a solvent mixture with a dye precursor dissolved therein, note for example the disclosure beginning in column 2, the working Examples, and Claim 1; a similar teaching is present in U.S. Pat. Nos. 4,622,267; 4,738,898 directed to microencapsulation by interfacial polyaddition of, for example, an aliphatic diisocyanate and an isocyanurate triamer, and wherein the aforementioned components can be interfacially reacted with a polyamine; the selection of carboxy methylcellulose, sodium salt, is illustrated in the working Examples, reference working Example 1, column 5, beginning at line 26; further, note the disclosure in column 3, beginning at line 46, wherein it is indicated that it is envisioned, for example, to encapsulate plant protection agents such as herbicides, fungicides, or insecticides, which makes then less hazardous to handle, and it is also intended to encapsulate the pharmaceutical products, food products, flavors, perfumes, colorants, paints, or catalysts, reference the disclosure in column 3, beginning at line 46; U.S. Pat. No. 4,766,051, the disclosure of which is totally incorporated herein by reference, directed to colored encapsulated toner compositions, and more specifically, cold pressure fixable colored toner compositions comprised of a core containing a polymer in which is dispersed pigment particles selected from the group consisting of cyan, magenta, red, yellow pigments, and mixtures thereof, and magnetites encapsulated within a polymeric shell formulated by an interfacial polymerization, note specifically, for example, the disclosure in column 3, beginning at line 35, and continuing on to column 15, and note that polyvinyl alcohol may be selected, and more specifically, for example, the organic phase can be dispersed by a polytron in an aqueous phase containing polyvinyl alcohol to obtain toner particles, see column 6, beginning at line 28, and note specifically the working Examples, especially working Example 11; and U.S. Pat. No. 4,193,889 directed to microencapsulation with modified polyisocyanates, and more specifically to microcapsules and a process thereof, the walls of which consist of polycondensates of a film forming aliphatic polyisocyanate containing at least one biurett group or polyaddition products thereof with a chain extending agent, reference the Abstract of the Disclosure; and note the disclosure in columns 2,3 and 4.

In a copending application directed to encapsulated toner, there were mentioned in a patentability search report the following U.S. patents: U.S. Pat. No. 4,727,101, the disclosure of which is totally incorporated herein by reference, which illustrates a free radical polymerization of a toner shell at elevated temperatures and more specifically is directed to the preparation of encapsulated toner compositions, which comprises mixing in the absence of a solvent a core monomer, initiator, pigment particles, a first shell monomer, stabilizer, and water, and thereafter adding a second shell monomer to enable an interfacial polymerization interaction, and subsequently affecting the free radical polymerization of the core monomer, reference the Abstract of the Disclosure for example; U.S. Pat. No. 4,777,104 the disclosure of which is totally incorporated herein by reference, which relates to processes for the formation of electrophotographic toners of certain desired sizes by radical polymerization, reference for example column 3, lines 26 to 41, and also note the disclosure in column 6 with respect to colorants, beginning at line 29; U.S. Pat. No. 4,524,199, the disclosure of which is totally incorporated herein by reference, which relates to stable polymeric dispersions, which dispersion comprises, for example, a polar dispersion medium having dispersed therein particles comprising a thermoplastic resin core having irreversibly anchored thereto a nonionic amphipathic steric stabilizer comprising a graft copolymer, reference for example column 2, beginning at line 45, and note column 4, beginning at line 57, and continuing on to column 5; U.S. Pat. No. 4,533,617 the disclosure of which is totally incorporated herein by reference, directed to heat fixable developers with a capsule structure containing a binder resin of a certain glass transition temperature and a colorant coated with a vinyl type polymer, reference for example the Abstract of the Disclosure, and note columns 4 through 10; U.S. Pat. No. 4,725,522 directed to processes for cold pressure fixable encapsulated toner compositions, particularly processes thereof wherein a water phase containing a stabilizing material is selected and hydrolysis is accomplished by heating and there is utilized interfacial polymerization to form the shell, reference for example the Abstract of the Disclosure, and also note columns 4 to 8, the disclosure of the aforementioned patent being totally incorporated herein by reference; U.S. Pat. No. 3,876,610 relating to the preparation of electrostatic toner materials with a size between 1 to 10 microns and containing a polymeric shell comprising a copolymer with a glass transition temperature of at least 40° C., see the Abstract of the Disclosure for example, the disclosure of the aforementioned patent being totally incorporated herein by reference; and U.S. Pat. No. 4,762,752 which discloses addition compounds suitable as dispersing agents, reference the Abstract of the Disclosure, for example the disclosure of the aforementioned patent being totally incorporated herein by reference.

Additionally, there is illustrated in U.S. Pat. No. 4,565,764 a pressure fixable microcapsule toner having a colored core material coated successively with a first resin wall and a second resin wall. The first resin wall has affinity to both the core material and the second resin wall. This patent teaches that the first resin wall may be of a material that becomes charged to a polarity opposite to that of the second resin wall and the core material.

Also, U.S. Pat. No. 4,520,091, the disclosure of which is toally incorporated herein by reference, illustrates a pressure fixable encapsulated electrostatographic toner material. The core comprises a colorant, a polymer, a solvent capable of dissolving the polymer or causing the polymer to swell, and an organic liquid incapable of dissolving the polymer or causing the polymer to swell, while the shell may consist of a polyamide resin. Preparation of the toner material is completed by interfacial polymerization.

Another patent, U.S. Pat. No. 4,708,924, the disclosure of which is totally incorporated herein by reference, describes a pressure fixable microcapsule type toner composed of a core material and an outer wall covering over the core material. The core material contains at least a combination of a substance having a glass transition point within the range of −90° C. to 5° C. with a substance having a softening point within the range of 25° C. to 180° C. This toner composition may comprise substances, such as polystyrene and poly(n-butylmethacrylate), and their copolymers.

Further, U.S. Pat. No. 4,254,201, the disclosure of which is totally incorporated herein by reference, illustrates a pressure sensitive adhesive toner consisting essentially of porous aggregates. Each aggregate consists essentially of a cluster of a multiplicity of individual granules of pressure sensitive adhesive substance, each granule being encapsulated by a coating film of a film-forming material. Particles of an inorganic or organic pigment and/or a magnetic substance are contained within the aggregate in the interstices between the granules and deposited on the surfaces of the encapsulated granules. The adhesive substance is selected from a copolymer of at least one monomer and as many as three other monomers.

In addition, U.S. Pat. No. 4,702,988, the disclosure of which is totally incorporated herein by reference, illustrates a process for the preparation of encapsulated toner. A monomer composition and a colorant are dispersed in a liquid dispersion medium in the presence of a solid fine powdery dispersion stabilizer. The liquid is pressurized and then ejected into a low pressure section to form particles of monomer composition. These particles are then subjected to suspension polymerization to produce toner particles.

In U.S. Pat. No. 4,727,011 there is disclosed a process for preparing encapsulated toner compositions, which comprises mixing, in the absence of a solvent, a core monomer, an initiator, pigment particles, a first shell monomer, stabilizer, and water; thereafter adding a second shell monomer, thereby enabling an interfacial polymerization reaction between the first and second shell monomers; and subsequently effecting a free radical polymerization of the core monomer. The disclosure of this patent is totally incorporated herein by reference.

Also, U.S. Pat. No. 4,855,209, the disclosure of which is totally incorporated herein by reference, discloses an encapsulated toner composition with a melting temperature of from about 65° C. to about 140° C. which comprises a core containing a polymer selected from the group consisting of polyethylene succinate, polyhalogenated olefins, poly($\alpha$-alkylstyrenes), rosin modified maleic resins, aliphatic hydrocarbon resins, poly($\epsilon$-caprolactones), and mixtures thereof; and pigment particles, where the core is encapsulated in a shell prepared by interfacial polymerization reactions.

There are disclosed in U.S. Pat. No. 4,307,169, the disclosure of which is totally incorporated herein by reference, microcapsular electrostatic marking particles containing a pressure fixable core, and an encapsulating substance comprised of a pressure rupturable shell, wherein the shell is formed by an interfacial polymerization. One shell prepared in accordance with the teachings of this patent is a polyamide obtained by interfacial polymerization. Furthermore, there is disclosed in U.S. Pat. No. 4,407,922, the disclosure of which is totally incorporated herein by reference, pressure sensitive toner compositions comprised of a blend of two immiscible polymers selected from the group consisting of certain polymers as a hard component, and polyoctyldecylvinylether-co-maleic anhydride as a soft component. Interfacial polymerization processes are also selected for the preparation of the toners of this patent. Also, there are disclosed in the prior art encapsulated toner compositions containing costly pigments and dyes, reference for example the color photocapsule toners of U.S. Pat. Nos. 4,399,209; 4,482,624; 4,483,912 and 4,397,483.

Further, U.S. Pat. No. 4,851,318 discloses an improved process for preparing encapsulated toner compositions which comprises mixing core monomers, an initiator, pigment particles, and oil soluble shell monomers, homogenizing the mixture into an aqueous surfactant solution to result in an oil-in-water suspension enabling an interfacial polymerization reaction between the oil soluble and the water soluble shell monomers, subsequently adding a low molecular weight polyethylene oxide surfactant protective colloid, and thereafter effecting free radical polymerization of the core monomers by heating. The disclosure of this U.S. Pat. No. 4,851,318 is totally incorporated herein by reference.

Moreover, illustrated in U.S. Pat. No. 4,758,506, the disclosure of which is totally incorporated herein by reference, are single component cold pressure fixable toner compositions, wherein the shell selected can be prepared by an interfacial polymerization process.

There is illustrated in U.S. Pat. No. 4,937,167, the disclosure of which is totally incorporated herein by reference, a process for controlling the electrical characteristics of colored toner particles.

There is also illustrated in U.S. Pat. No. 5,035,970, the disclosure of which is totally incorporated herein by reference, an encapsulated toner composition comprised of a core comprised of pigments or dyes, and a polymer; and wherein the core is encapsulated in a polyester shell with functional groups thereon, and derived from diacid halide polyesters.

U.S. Pat. No. 5,037,716, the disclosure of which is totally incorporated herein by reference, illustrates encapsulated toners with a Daxad dispersant. To stabilize heat fusible particles at elevated temperatures, the addition of a Daxad dispersant is used to prevent particle agglomeration and coalescence. The encapsulated toner composition comprises a core comprised of a performer polymer and/or monomer or monomers, a free radical initiator, pigment or dye particles where the core is dispersed in an emulsifier solution, and subsequently encapsulated in a polymeric shell and wherein the toner is stabilized by Daxad dispersants during core polymerization, where the dispersant is a naphthalene sulfonate formaldehyde condensate material. With this process the emulsifier was not able to lower the GSD below 1.5 without classification. The incorporation of Daxad can be added after the particle generation step.

Free radical polymerization is a well known art, and can be generalized as bulk, solution, emulsion or suspension polymerization. These polymerizations are commonly selected for the preparation of certain polymers. The kinetics and mechanisms for free radical polymerization of monomer(s) is also well known. In these processes, the control of polymer properties such as molecular weight and molecular weight dispersity can be effected by initiator, species concentrations, temperatures, and temperature profiles. Similarly, conversion of monomer is effected by the above variables.

Interfacial polymerization processes are described in British Patent Publication 1,371,179, the disclosure of which is totally incorporated herein by reference, which publication illustrates a method of microencapsulation based on in situ interfacial condensation polymerization. More specifically, this publication discloses a process which permits the encapsulation of organic pesticides by the hydrolysis of polymethylene polyphenylisocyanate or toluene diisocyanate monomers. Also, the shell-forming reaction disclosed in the aforementioned publication is initiated by heating the mixture to an elevated temperature at which point the isocyanate monomers are hydrolyzed at the interface to form amines, which then react with unhydrolyzed isocyanate monomers to enable the formation of a polyurea microcapsule wall.

Furthermore, other prior art, primarily of background interest, includes U.S. Pat. Nos. 4,254,201; 4,465,755 and Japanese Patent Publication 58-100857. The Japanese publication discloses a capsule toner with high mechanical strength, which is comprised of a core material including a display recording material, a binder, and an outer shell, which outer shell is preferably comprised of a polyurea resin. In the '201 patent there are disclosed encapsulated electrostatographic toners wherein the shell material comprises at least one resin selected from polyurethane resins, a polyurea resin, or a polyamide resin. In addition, the '755 patent discloses a pressure fixable toner comprising encapsulated particles containing a curing agent, and wherein the shell is comprised of a polyurethane, a polyurea, or a polythiourethane. Moreover, in the '201 patent there are illustrated pressure sensitive adhesive toners comprised of clustered encapsulated porous particles, which toners are prepared by spray drying an aqueous dispersion of the granules containing an encapsulated material.

Also, there are illustrated in U.S. Pat. No. 4,280,833 encapsulated materials prepared by interfacial polymerization in aqueous herbicidal compositions. More specifically, as indicated in column 4, beginning at line 9, there is disclosed a process for encapsulating the water immiscible material within the shell of the polyurea, a water immiscible organic phase which consists of a water immiscible material, that is the material to be encapsulated, and polymethyl polyphenyl isocyanate is added to the aqueous phase with agitation to form a dispersion of small droplets of the water immiscible phase within the aqueous phase; and thereafter, a polyfunctional amine is added with continuous agitation to the organic aqueous dispersion, reference column 4, lines 15 to 27. Also, note column 5, line 50, wherein the amine selected can be diethylene triamine, and the core material can be any liquid, oil, meltable solid or solvent soluble material, reference column 4, line 30. A similar teaching is present in U.S. Pat. No. 4,417,916.

In U.S. Pat. No. 4,599,271, the disclosure of which is totally incorporated herein by reference, there are illustrated microcapsules obtained by mixing organic materials in water emulsions at reaction parameters that permit the emulsified organic droplets of each emulsion to collide with one another, reference the disclosure in column 4, lines 5 to 35. Examples of polymeric shells are illustrated, for example, in column 5, beginning at line 40, and include isocyanate compounds such as toluene diisocyanate, and polymethylene polyphenyl isocyanates. Further, in column 6, at line 54, it is indicated that the microcapsules disclosed are not limited to use on carbonless copying systems; rather, the film material could comprise other components including xerographic toners, see column 6, line 54.

Other prior art includes U.S. Pat. No. 4,520,091, the disclosure of which is totally incorporated herein by reference, which illustrates an encapsulated toner material wherein the shell can be formed by reacting a compound having an isocyanate with a polyamine, reference column 4, lines 30 to 61, and column 5, line 19; and U.S. Pat. No. 3,900,669 illustrating a pressure sensitive recording sheet comprising a microcapsule with polyurea walls, and wherein polymethylene polyphenyl isocyanate can be reacted with a polyamine to produce the shell, see column 4, line 34.

Illustrated in U.S. Pat. No. 4,758,506, the disclosure of which is totally incorporated herein by reference, are single component cold pressure fixable toner compositions, wherein the shell selected can be prepared by an interfacial polymerization process.

In U.S. Pat. No. 5,043,240, the disclosure of which is totally incorporated herein by reference, there are illustrated encapsulated toners with a core comprised of a polymer binder, pigment or dye, and thereover a polymeric shell, which contains a soft and flexible component, permitting, for example, proper packing of shell materials resulting in the formation of a high density shell structure, which can effectively contain the core binder and prevent its loss through diffusion and leaching process. The soft and flexible component in one embodiment is comprised of a polyether function. Specifically, in one embodiment there is disclosed in the aforementioned patent encapsulated toners comprised of a core containing a polymer binder, pigment or dye particles, and thereover a shell preferably obtained by interfacial polymerization, which shell has incorporated therein a polyether structural moiety. Another specific embodiment of the patent is directed to encapsulated toners comprised of a core of polymer binder, pigment, dye or mixtures thereof, and a polymeric shell of a polyether-incorporated polymer, such as a poly(ether urea), a poly(ether amide), a poly(ether ester), a poly(ether urethane), mixtures thereof, and the like.

In U.S. Pat. No. 5,045,422, the disclosure of which is totally incorporated herein by reference, there are illustrated encapsulated toners with a core comprised of a polymer binder, pigment or dye, and thereover a hydroxylated polyurethane shell, and which shell has the ability to effectively contain the core binder and prevent its loss through diffusion and leaching process. Specifically, in one embodiment there is provided in accordance with the patent encapsulated toners comprised of a core containing a polymer binder, pigment or dye particles, and thereover a hydroxylated polyurethane shell derived from the polycondensation of a polyisocyanate and a water-soluble carbohydrate, such as a monosaccharide, a disaccharide or their derivatives, with the polycondensation being accomplished by the known interfacial polymerization methods. Another specific embodiment of the patent is directed to pressure fixable encapsulated toners comprised of a core of polymer binder, magnetic pigment, color pigment, dye or mixtures thereof, and a hydroxylated polyurethane shell, and coated thereover with a layer of conductive components such as carbon black.

Accordingly, there is a need for encapsulated toner compositions with many of the advantages illustrated herein. More specifically, there is a need for custom, and highlight color encapsulated toners wherein the pigments are passivated, and wherein the toners may contain shells that eliminate or minimize the loss of core components such as the binder resin. Also, there is a need for encapsulated toners wherein color images with excellent resolution and superior fix can be obtained.

SUMMARY OF THE INVENTION

It is a feature of the present invention to provide a mixture of encapsulated toner compositions with many of the advantages illustrated herein.

It is also a feature of the present invention to provide processes for colored encapsulated toner compositions which provide desirable toner properties such as high image fix, excellent image crease and rub resistance, stable triboelectrical characteristics, for example from about −50 to +50 microcoulombs per gram, and preferably from about −25 to +25 microcoulombs per gram; excellent admix characteristics, for example less than two minutes, and preferably less than about 1 minute as determined by a known charge spectrograph; and excellent image permanence characteristics.

In another feature of the present invention there are provided custom color, and highlight color encapsulated toner compositions, especially those comprised of a first and second encapsulated toner comprised of a core of polymer binder, colorants such as pigments or dyes, or mixtures thereof, and thereover a microcapsule shell prepared, for example, by interfacial polymerization, and wherein the pigment for the first toner is different than the pigment for the second toner.

Another feature of the present invention is the provision of encapsulated toners that can be selected for custom color and highlight color imaging processes, including processes wherein heat fusing or pressure fixing is selected.

In another feature of the present invention there are provided simple and economical preparative processes for colored toner compositions involving an interfacial shell forming polymerization and an in situ free radical core binder forming polymerization whereby the shell formation, core binder formation, and the resulting toner material properties can be independently and desirably controlled.

Another feature of the present invention resides in the provision of simple and economical processes for colored encapsulated toner compositions with heat or pressure fusible shells obtained by a chemical microencapsulation technique involving an interfacial polycondensation and a free radical polymerization process.

Moreover, in a further feature of the present invention there are provided processes for pressure fixable toner compositions wherein the core binders thereof are obtained via free radical polymerization of liquid vinyl monomers, and which monomers also serve as a diluent and as a reaction medium for polymerization, thus eliminating the utilization of undesirable organic solvents in the preparation process.

Another feature is the provision of encapsulated toner compositions comprised of a core of acrylate binder, methacrylate binder, styryl binder, or copolymers thereof, and a colorant or colorants, encapsulated within a polymeric shell derived from polycondensation of a polyisocyanate and an amine.

Yet another feature of the present invention is that wastage of off-specification toner is minimized because it can be reblended with additional amounts of either component, or a third component to achieve the target color.

A further feature of the present invention is that the particle size is preserved during the blending operation, wherein the blended toners have the same image resolution as the toners in the primary set.

Yet another feature of the present invention is that the blended toner pigments cannot agglomerate with one another as they might within a single toner, because they are isolated in separate toner particles in the primary set of toners.

A further feature of the present invention is that small batches of highlight or custom color toners can be blended from the primary set at low cost.

A further feature of the process of the present invention is that the primary toner synthesis steps can be performed on an economically large scale, for example greater than 2,000 kilograms can be obtained, while the blending steps can be performed economically on a very small scale, for example, as small as 1 kilogram.

A further feature of the present invention is to expand the range and number of economically feasible highlight or custom color toners available.

Yet another feature of the present invention is the minimization of toner inventory costs since only the primary blendable toners need to be stored.

A further feature of the present invention is the simplification of the research and development optimization of security toners, for example, by including an IR absorbing primary toner in the blend.

A further feature of the present invention is that the same primary set of blendable toners can be maintained for pictorial color toners as well as for highlight and custom color toners, for example a primary set of three color toners (cyan, magenta, and yellow) plus black could be used for pictorial color printing and copying as well as to make a highlight set of blended red, blue, brown, and green toners, and to prepare blended custom color toners while requiring only optimization of one set of triboelectric properties.

A further feature of the present invention is that the optional addition of white, unpigmented, fluorescent, metallic, silver, gold or metallic toners to the primary toner set could further increase the range of potential highlight and custom colors available from blending encapsulated passivated toners.

Yet another feature of the present invention is that encapsulation of conductive metals will yield the insulating gold, silver and bronze colored toners necessary for two component or single component development.

A further feature of the present invention is that encapsulated toners can be readily synthesized in small particle sizes as small as 2 microns, which feature enables high copy quality at little or no additional cost.

In yet another feature of the present invention, magnetic ink character recognition (MICR) toner can be a custom highlight color, greatly expanding the range of copiers and printers with MICR capability.

These and other features of the present invention can be accomplished by the provision of toners and more specifically encapsulated toners. In one embodiment of the present invention, there are provided processes for custom color encapsulated toners with a core and a polymeric shell thereover. Specifically, in one embodiment there are provided in accordance with the present invention custom color encapsulated toners comprised of at least two encapsulated toners each comprised of a core comprised of a preformed polymer and/or monomers, a free radical initiator which initiates the free radical polymerization of the core monomers when heated, pigment and/or dye particles, and wherein the core monomer mixture is dispersed into an emulsifier solution, and subsequently encapsulated by a polymeric shell followed by core polymerization at elevated temperatures via free radical polymerization, wherein the emulsifier or surfactant is comprised of an organic methyl cellulose, hydroxylated methylcellulose components or mixtures thereof, such as TYLOSE® available from Fluka Inc. of Canada or METHOCEL® available from Dow Chemical, and wherein the pigment for each toner is dissimilar.

FURTHER DESCRIPTION OF THE INVENTION

The blended toners of the present invention can be prepared in an embodiment thereof by first preparing a primary set of two or more colored toners, for example, by microencapsulation processes, wherein, for example, a thin heat fusible polymeric shell having a relatively low glass transition temperature of from about 50° C. to about 180° C. is generated by an interfacial condensation polymerization process at room temperature around a colored pigmented or dyed core material with a lower glass transition temperature of less than 100° C., and secondly by blending two or more toners from the primary set using methods well known in the art, including, for example, ball milling, propeller type mixers such as Lodige or Lighnin', tumbling mixers and the like, such blending being performed optionally in the presence of a suitable carrier selected for electrophotography.

Embodiments of the present invention include a process for obtaining custom color toner compositions which comprises admixing at least two encapsulated toners wherein each toner is comprised of a core comprised of a polymer binder, pigment, dye, or mixtures thereof, and a polymeric shell, and wherein the pigment, dye, or mixtures thereof is different for each toner, thereby resulting in a toner with a color different than each of said encapsulated toners; a process wherein there are selected two encapsulated toner compositions comprised of a first and second encapsulated toner, each toner being comprised of a core comprised of a polymer binder, pigment, dye, or mixtures thereof, and a polymeric shell, wherein the second toner contains a pigment, dye, or mixtures thereof that is unequivalent to the first pigment, dye, or mixtures thereof, and the triboelectric charge on a third toner is substantially equal to the triboelectic charge on the first and second encapsulated toner.

In one embodiment, with the process of the present invention wherein microencapsulation is selected, there can be obtained primary and blended toners with a thin heat fusible polymeric shell with a relatively low glass transition temperature of from about 50° C. to about 180° C. and wherein interfacial condensation polymerization processes are selected, which processes can be accomplished at room temperature. Interfacial polymerization is accomplished in some embodiments of the present invention around a colored, pigmented or dyed core material containing, for example, resin components with low glass transition temperatures of, for example, less than 100° C. and wherein this pigmented organic low Tg core material is dispersed into an aqueous solution of a hydroxyethylmethyl cellulose material commercially available from Fluka Inc. as TYLOSE® to form an oil-in-water dispersion which subsequently undergoes interfacial polymerization. After shell formation, the core monomers undergo free radical polymerization at elevated temperatures of, for example, 85° C. for an effective period of time of, for example, about 4 to 24 hours without particle agglomeration and coalescence, for example.

The encapsulated primary toners of the present invention can be prepared in one embodiment of the present invention by providing a preformed polymer, such as a copolymer comprised of about 52 percent by weight of styrene and 48 percent by weight of n-butyl methacrylate, and a pigment, such as Lithol Scarlet, flushed into a copolymer resin comprised of about 65 percent by weight of styrene and about 35 percent by weight of n-butyl methacrylate and monomer or monomers, such as styrene and n-butyl methacrylate or stearyl methacrylate in a 50:50 ratio; forming an organic phase with initiators and an organic shell component, such as a diisocyanate or a diacid chloride; dispersing the aforementioned organic phase into a surfactant emulsifier solution; adding to the resulting mixture an aqueous shell component such as a diamine or bisphenol; effecting interfacial polymerization; and subsequently effecting free radical polymerization.

Further, in accordance with the present invention there are provided processes for black and colored encapsulated toner compositions, which process comprises mixing with from about 30 to about 90 parts (by weight) of water, from about 5 to about 70 parts of a core monomer in a core monomer/polymer mixture including acrylates, methacrylates, styrenic monomers, butadiene, isoprene, and the like, including mixtures of the above, or other substantially equivalent vinyl monomers, and combinations of vinyl monomers with an azo type free radical initiator, such as azoisobutyronitrile, azodimethylvaleronitrile, azobiscyclohexanenitrile, 2-methylbutyronitrile, or peroxide type free radical initiators such as benzoyl peroxide, lauroyl peroxide, and the like, or mixtures thereof; and pigment particles, including colored organic pigments or dyes, in an amount of from about 1 percent to about 15 percent by weight of the toner; magnetites, colored magnetites, or carbon blacks in an amount of from about 0.25 to about 70 percent by weight of the toner; or other similar solid inert materials of a particle size of from about submicron, for example, less than 1 micron to about 5 microns; adding an organic soluble shell comonomer such as isocyanates including toluene diisocyanate, meta-tetramethylxylene diisocyanate (m-TMXDI), trimethylhexamethylene diisocyanate (TMDI), hexane diisocyanate (HDI), diisocyanate prepolymers which are polyether based liquid urethane prepolymer such as the Adiprene series available from DuPont; XPS and XPH series which are toluene diisocyanate terminated polyethylene oxide prepolymers available from Air Products; sebacoyl chloride, adipic acid, toluene bischloroformate, hexanedisulfonic acid, and optionally adding a shell crosslinking agent such as DESMODUR RF® (Bayer); and dispersing the above-mentioned organic pigmented core monomer material containing the organic shell component into an aqueous emulsifier solution comprised of TYLOSE 93800®, a hydroxyethylmethyl cellulose available from Fluka, 64620 METHOCEL MC®, a methyl cellulose, 64605 METHOCEL MC®, a hydroxypropylmethyl cellulose, 64655 METHOCEL 60 HG®, a methyl cellulose, METHOCEL E5 PREMIUM®, a hydroxypropylmethyl cellulose, all available from Dow Chemical; a TYLOSE® emulsifier hydroxyethylmethyl cellulose, available from Fluka Inc., mixtures thereof in some embodiments, and the like; and subsequently accomplishing by the addition of a water soluble shell comonomer such as diethylene triamine, 1,3-cyclohexanebis(methylamine), 2-methylpentamethylene diamine, hexane diamine, hexamethylene diamine, bisphenol A or any other water soluble copolycondensation coreactant to the aforementioned formed suspension; accomplishing an interfacial polymerization at the interface of the aforementioned mixture; and thereafter affecting a free radical polymerization by heating the resulting suspension and allowing the disassociation of chemical initiator to free radicals and initiation of free radical polymerization by the reaction with core monomer(s).

Illustrative examples of core monomers present in an effective amount of, for example, from about 60 to about 99 percent by weight of the core monomer/polymer mixture include acrylates, methacrylates, diolefins, and the like. Specific examples of core monomers are methyl acrylate, ethyl acrylate, n-propyl acrylate, isopropyl acrylate, n-butyl acrylate, isobutyl acrylate, t-butyl acrylate, n-pentyl acrylate, 2-methylbutyl acrylate, 3-methylbutyl acrylate, hexyl acrylate, heptyl acrylate, 2-ethylhexyl acrylate, octyl acrylate, decyl acrylate, lauryl acrylate, hexadecyl acrylate, stearyl acrylate, methyl methacrylate, ethyl methacrylate, n-propyl methacrylate, isopropyl methacrylate, n-butyl methacrylate, isobutyl methacrylate, t-butyl methacrylate, n-pentyl methacrylate, 2-methylbutyl methacrylate, 3-methylbutyl methacrylate, hexyl methacrylate, heptyl methacrylate, 2-ethylhexyl methacrylate, octyl methacrylate, decyl methacrylate, lauryl methacrylate, hexadecyl methacrylate, stearyl methacrylate, benzyl acrylate, benzyl methacrylate, cyclohexyl acrylate, cyclohexyl methacrylate, ethoxy propyl acrylate, m-tolyl acrylate, dodecylstyrene, hexylmethylstyrene, nonylstyrene, tetradecylstyrene, α-methylstyrene, vinyl acetate, linear and branched vinyl alkylates, butadiene, isoprene, chlorinated olefins, styrene-butadiene oligomer or polymers, ethylene-vinyl acetate oligomers, isobutyleneisoprene copolymers with residual double bonds where the weight-average molecular weight ($M_w$) is from about 5,000 to about 20,000 , vinylphenolic materials, alkoxy alkyl acrylates, alkoxy alkyl methacrylates, cyano alkyl acrylates and methacrylates, alkoxy alkyl acrylates and methacrylates, methyl vinyl ether, maleic anhydride, and isomers of the above, and other known vinyl monomers and mixtures thereof, reference for example U.S. Pat. No. 4,298,672, the disclosure of which is totally incorporated herein by reference, polylauryl methacrylate, mixtures thereof; and the like. These monomers may be present alone or as mixtures of monomers to form copolymers.

The monomers may also be present in conjunction with preformed polymers, thus polymerization of the core monomer or monomers results in a polymer blend, which may be both a compatible blend, wherein the polymers are miscible and form a uniform, homogeneous mixture, or an incompatible blend, wherein one polymer is present in discrete regions or domains within the other polymer. Examples of optional additional suitable preformed polymer usually present in an amount of from about 0.1 percent to about 40 percent of the toner weight include styrene-butadiene copolymers, styrene-acrylate and styrene-methacylate copolymers, ethylene-vinylacetate copolymers, isobutylene-isoprene copolymers and the like. Generally, various effective core monomer or monomers up to, for example, 25 may be selected for the core including styrene acrylates, styrene methacrylates, styrene butadienes, particularly with a high percentage of styrene, that is for example from about 50 to about 95 weight percent of styrene, polyesters, other similar known monomers, and the like.

In one specific embodiment of the present invention, the encapsulated toner is formulated by an interfacial/-free radical polymerization process in which the shell formation and the core formation are controlled independently. Thus, for example, the core materials selected for the toner composition are blended together, followed by encapsulation of these core materials within a polymeric material. The encapsulation process generally takes place by means of an interfacial polymerization reaction, and the core monomer polymerization process is generally accomplished by means of a free radical reaction. More specifically, the process includes the steps of preparing a core by mixing a blend of a core monomer or monomers, one or more free radical polymerization initiators, a pigment or pigments or dyes, a first shell monomer, and, optionally, a core polymer or polymers; forming an organic liquid phase which is dispersed into an aqueous emulsifier such as a methyl cellulose or hydroxyethylmethyl cellulose phase containing a water soluble surfactant or emulsifier to form an oil in water suspension; the addition of a water soluble second shell monomer during constant agitation; and subjecting the mixture to an interfacial polymerization at room temperature.

After the interfacial polymerization is complete and without further addition of any other component, the free radical polymerization of the core monomers within the encapsulated core is effected by increasing the temperature of the aforementioned formed suspension, thereby enabling the initiator to initiate polymerization of the core monomers and resulting in a toner composition comprising a polymeric core containing dispersed pigment, dye, or mixtures thereof encapsulated by polymeric shell. Free radical polymerization of the core monomers generally is at a temperature of from about 50° C. to about 130° C., and preferably from about 60° C. to about 120° C. for a period of from about 4 hours to about 24 hours. The resulting toner material is then washed to remove the stabilizing materials and subsequently dried, preferably utilizing the known fluid bed drying, or spray drying technique, or freeze drying. Further details regarding encapsulation by interfacial/-free radical polymerization are illustrated in U.S. Pat. No. 4,727,011, the disclosure of which is totally incorporated herein by reference.

With respect to the polymeric core material, preformed polymers may be included as a component of the core as indicated herein. These polymers are compatible with and readily soluble in the core monomers. Examples of suitable polymers include polymers of the monomers illustrated heretobefore as suitable core monomers as well as copolymers of these monomers, such as styrene-butadiene copolymers, styrene-acrylate and styrene-methacrylate copolymers, ethylene-vinylacetate copolymers, isobutylene-isoprene copolymers, and the like.

In particular, a "flush" of the desired organic pigment in a preformed polymer, for example HOSTAPERM PINK E® in a copolymer resin comprised of about 65 percent by weight of styrene and about 35 percent by weight of n-butyl methacrylate, can be mixed with styrene and/or acrylate monomers to form the core material, and these monomers can be subsequently polymerized after shell formation to produce the fully polymerized core in which the dispersion of pigment is extremely uniform. For the process of the present invention, the different colored toners need not contain the same core monomers or polymers since the charging characteristics of the toners can be determined by the shell material.

Waxes or wax blends may also be added to the core in effective amounts of, for example, from about 0.5 percent by weight to about 20 percent by weight of the toner to improve the low melting properties and/or release properties of the toner. Specific examples of waxes include candelilla, bees wax, sugar cane wax, carnuba wax, paraffin wax and other similar waxes, particularly those with a melting point of about 60° C.

Typical suitable colored pigments may be selected for the toners and processes of the present invention provided, for example, that they are substantially unreactive with the components employed to form the shell in an interfacial polymerization process and that they do not substantially interfere with the free radical polymerization of the core monomer or monomers. Also, the pigment for each of the encapsulated toners is dissimilar, for example a different pigment is selected for the first encapsulated toner, and a different pigment is selected for the second encapsulated toner, and the encapsulated toners are subsequently blended, or admixed to achieve the appropriate desired custom color encapsulated toner. Pigment examples are known and include Violet Toner VT-8015 (Paul Uhlich), Normandy Magenta RD-2400 (Paul Uhlich), Paliogen Violet 5100 (BASF), Paliogen Violet 5890 (BASF), Permanent Violet VT2645 (Paul Uhlich), Heliogen Green L8730 (BASF), Argyle Green XP-111-S (Paul Uhlich), Brilliant Green Toner GR 0991 (Paul Uhlich), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), Heliogen Blue L6900, L7020 (BASF), Heliogen Blue K6902, K6910 (BASF), Heliogen Blue D6840, D7080 (BASF), Sudan Blue OS (BASF), Neopen Blue FF4012 (BASF), PV Fast Blue B2G01 (American Hoechst), Irgalite Blue BCA (Ciba-Geigy), Paliogen Blue 6470 (BASF), Sudan III (red orange) (Matheson, Coleman, Bell), Sudan II (orange) (Matheson, Coleman, Bell), Sudan IV (orange) (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Novoperm Yellow FGL (Hoechst), Permanent Yellow YE 0305 (Paul Uhlich), Lumogen Yellow D0790 (BASF), Suco-Gelb L1250 (BASF), Suco-Yellow D1355 (BASF), Sico Fast Yellow D1355, D1351 (BASF), Hostaperm Pink E (American Hoechst), Fanal Pink D4830 (BASF), Cinquasia Magenta (DuPont), Paliogen Black L0084 (BASF), Pigment Black K801 (BASF), and carbon blacks such as REGAL 330® (Cabot), Carbon Black 5250 and Carbon Black 5750 (Columbian Chemicals Company); magnetites; color magnetites; red, green, blue, brown, Heliogen Blue L6900, D6840, D7080, D7020, Pylam Oil Blue and Pylam Oil Yellow, Pigment Blue 1 available from Paul Uhlich & Company Inc., Pigment Violet 1, Pigment Red 48, Lemon Chrome Yellow DCC 1026, E.D. Toluidine Red and Bon Red C available from Dominion Color Corporation Ltd., Toronto, Ontario, Novaperm Yellow FGL, Hostaperm Pink E from Hoechst, Cinquasia Magenta available from E.I. DuPont de Nemours & Company, Oil Red 2144 available from Passaic Color and Chemical, Fanal Pink, Lithol Scarlet, Neopen Blue, Luna Yellow, and the like, which pigments are optionally flushed into a polymer such as a styrene-n-butyl methacrylate. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. The aforementioned pigments are incorporated into the encapsulated toner compositions in various suitable effective amounts providing the objectives of the present invention are achieved. In one embodiment, these colored pigment particles are present in the toner composition in an amount of from about 1 percent by weight to about 15 percent by weight calculated on the weight of the dry toner. Colored magnetites, such as mixtures of Mapico Black, and cyan components may also be used as pigments.

Various suitable free radical initiators may be employed, especially when the core is prepared by a free radical polymerization, subsequent to the interfacial polymerization reaction that forms the toner shell provided that the temperature for less than or equal to 10 hour half-life of the initiator is less than about 120° C., and preferably less than about 90° C. Suitable free radical initiators include azo type initiators, such as 2,2'-azobis(isobutyronitrile), 2,2'-azobis(2,4-dimethylvaleronitrile), 2,2'-azobis(cyclohexanenitrile), 2,2'-azobis-(2-methylbutyronitrile), 2,2'-azobis(2,4-dimethyl-4-methoxyvaleronitrile), mixtures thereof, and the like. Additional free radical initiators include peroxide type initiators such as benzoyl peroxide, lauroyl peroxide and 2,5-dimethyl-2,5-bis(2-ethylhexanoylperoxy)hexane, LUPERSOL 256® (Pennwalt), and mixtures thereof. Typically, the initiator is present in the core material being activated at temperatures of from about 40° C. to about 100° C. The low temperature initiator is generally present in an effective amount of, for example, from about 0.5 to about 6 percent by weight of the core monomers, and preferably from about 2 to about 4 percent by weight of the core monomers. Optionally, a high temperature initiator may also be present in the core material being activated at temperatures of over 65° C. The high temperature initiator may be present in effective amounts of, for example, from 0 to about 4 percent by weight of the core monomers, and preferably from about 0.5 to about 2 percent by weight of the core monomers.

Suitable shell monomers are usually selected from monomers wherein the number of chemical reacting groups per molecule is two or more. The number of reacting groups per molecule is referred to as the chemical functionality. An organic soluble shell monomer, which has a functionality of 2 or more, reacts with an aqueous soluble shell monomer, which has a functionality of 2 or more, via interfacial polymerization to generate the shell polymer in an embodiment of the present invention. Examples of organic soluble shell monomers are sebacoyl chloride, terephthaloyl chloride, phthaloyl chloride, isophthaloyl chloride, azeloyl chloride, glutaryl chloride, adipoyl chloride and hexamethylene diisocyanate purchased from Fluka; 4,4'-dicyclohexylmethane diisocyanate (DESMODUR W TM), and a 80:20 mixture of 2,4-and 2,6-toluene diisocyanate (TDI) purchased from Mobay Chemical Corporation; trans-1,4-cyclohexane diisocyanate purchased from Aldrich, meta-tetramethylxylene diisocyanate (m-TMXDI) from Cyanamid, trimethylhexamethylene diisocyanate (TMDI) purchased from Nuodex Canada and 4,4'- methyldiphenyl diisocyanate (ISONATE 125M TM or MDI) purchased from The Upjohn Company. Examples of crosslinking organic soluble shell monomers, which have a functionality greater than 2, are 1,3,5-benzenetricarboxylic acid chloride purchased from Aldrich; ISONATE 143L TM (liquid MDI based on 4,4'-methyldiphenyl diisocyanate) purchased from The Upjohn Company; and tris(isocyanatophenyl) thiophosphate (DESMODUR RF TM) purchased from Mobay Chemical Corporation. Examples of monomers soluble in aqueous media and with a functionality of 2 include 1,6-hexanediamine, 1,4-bis(3-aminopropyl)piperazine, 2-methylpiperazine, m-xylene-$\alpha,\alpha'$-diamine, 1,8-diamino-p-menthane, 3,3'-diamino-N-methyldipropylamine and 1,3-cyclohexanebis(methylamine) purchased from Aldrich; 1,4-diaminocyclohexane and 2-methylpentanediamine (DYTEK A) purchased from DuPont; 1,2-diaminocyclohexane, 1,3-diaminopropane, 1,4-diaminobutane, 2,5-dimethylpiperazine and piperazine purchased from Fluka; fluorine-containing 1,2-diaminobenzenes purchased from PCR Incorporated; and N,N'-dimethylethylenediamine purchased from Alfa, and bisphenol A (2,2'-bis(4-hyroxyphenyl)propane), and other bisphenols, including hydroquinone, methylhydroquinone, 4,4'-biphenol, and other alkyl and alkoxy substituted biphenols and bisphenols. Other aqueous soluble shell monomers having a functionality greater than 2 are diethylenetriamine and bis(3-aminopropyl)amine obtained from Fluka and tris(2-aminoethyl)amine (TREN-HP) purchased from W.R. Grace Company, and the like.

More than one organic phase monomer can be used to react with more than one aqueous phase monomer. Although formation of the shell entails reaction in an embodiment between at least two shell monomers, one soluble in the organic phase and one soluble in aqueous phase, as many as 5 or more monomers soluble in the organic phase and as many as 5 monomers soluble in aqueous phase can be reacted to form the shell. In some preferred instances, 2 monomers soluble in the organic phase and 2 monomers soluble in aqueous phase can be reacted to form the shell.

Another class of shell monomers, which can be selected in the aqueous phase or the organic phase as minor shell components, is functionalized prepolymers. Prepolymers or macromers are long chain polymeric materials which usually have low mechanical integrity and low molecular weights, such as weight average molecular weights of less than 10,000, but have functional groups on each end of the molecule that react with the shell monomers and can be incorporated into the shell. Examples of such materials that can be selected in the organic phase are isocyanate prepolymers such as ADIPRENE L-83 TM and L-167 TM from DuPont, XPS and XPH from Air Products, and the like. The class of Jeffamine materials such as JEFFAMINE ED-6000 TM, ED-900 TM, D-4000 TM, C-346 TM, DU-700 TM and EDR-148 TM from Texaco Chemical Company are aqueous prepolymers which can be incorporated into the shell as the aqueous soluble monomer.

The toner compositions in an embodiment of the present invention generally comprise from about 1 to about 15 percent by weight, and preferably from about 2 to about 10 percent by weight, of the pigment or pigments or dyes, from about 2 to about 50 percent by weight, and preferably from about 5 to about 25 percent by weight, of the polymeric shell, including any grafted or adsorbed emulsifiers, and from about 35 to about 96 percent by weight, and preferably from about 65 to about 95 percent by weight, of the core monomers and polymers. Within the polymeric shell, the molar ratio of the organic soluble monomer to the aqueous soluble monomer is from about 1:1 to about 1:4, and preferably from about 1:1 to about 1:1.5. Within the mixture of core monomers and polymers, the optional preformed polymers are present in an amount of from about 0 to about 40 percent by weight, preferably from about 0 to about 25 percent by weight, of the monomer/polymer mixture, and the monomers are present in an amount of from about 60 to about 100 percent by weight, preferably from about 75 to about 100 percent by weight, of the monomer/polymer mixture.

Shell polymers suitable for use with the present invention are known and include those mentioned herein which may be formed in an interfacial polymerization process. Typical known shell polymers include polyureas, polyurethanes, polyesters, thermotropic liquid crystalline polyesters, polycarbonates, polyamides, polysulfones, and the like, or mixtures of these polymers such as poly(urea-urethanes), poly(ester-amides), and the like, which can be formed in a polycondensation reaction of suitably terminated prepolymers or macromers with different condensation monomers. For example, a preformed alcohol terminated urethane prepolymer can be copolymerized with a diacyl halide to form a poly(ester-urethane) in an interfacial reaction, or an amine terminated amide prepolymer can be copolymerized with a diisocyanate to produce a poly(urea-amide) copolymer. Epoxy monomers or oligomers such as EPIKOTE 819 TM can also be added in amounts of from about 0.01 percent to about 30 percent to copolymerize into the shell as strengthening agents. Various polyfunctional shell monomers, such as triamines, triisocyanates, and triols can be employed in small quantities of from about 0.01 percent to about 30 percent as crosslinking agents to introduce rigidity and strength into the shells. Shell polymers can also be formed by the reaction of aliphatic diisocyanates, such as meta-tetramethylene diisocyanate and a polyamine, reference for example the U.S. Pat. No. 5,037,716 mentioned herein.

A surfactant or emulsifier, such as the TYLOSE TM materials or the METHOCELS TM, can generally be added to disperse the hydrophobic particles in the form of toner size droplets in the aqueous medium and for stabilization of these droplets against coalescence or agglomeration prior to shell formation, during shell formation and also during core monomer polymerization. The types of emulsifiers employed which usually enable complete particle stabilization and also control the particle size and size distribution of the components include TYLOSE 93800 TM, a hydroxyethylmethyl cellulose, hydroxy propyl methyl cellulose, other hydroxyalkylmethyl celluloses methyl cellulose materials, and the like. These emulsifiers can also be used alone or in combination with other emulsifiers as co-emulsifiers such as poly(vinylalcohol), polyethylene sulfonic acid salt, polyvinylsulfate ester salt, carboxylated poly(vinylalcohol), water soluble alkoxylated diamines or similar water soluble block copolymers, gum arabic, albumin, polyacrylic acid salt, block copolymers of propylene oxide and ethylene oxide, gelatin, phthalated gelatin, succinated gelatin salts of alginic acid and the like. In addition, water soluble inorganic salts may also be employed as co-emulsifiers to stabilize the dispersion, such as trisodium polyphosphate, tricalcium polyphosphate and the like. The aforementioned emulsifier is present in an effective amount as illustrated herein, and with regard to the coemulsifier, various suitable effective mixes thereof are selected, which mixtures contain an effective amount of the emulsifiers illustrated herein such as hydroxy ethyl methyl cellulose and a second or plurality of other emulsifiers such as polyvinyl alcohol wherein the first emulsifier is present in the aqueous phase in an amount, for example, of from about 0.001 to about 10 weight percent; and the second or plurality of emulsifiers in total are present in an amount of from 0.001 to about 10 weight percent and preferably from about 0.5 to about 2 weight percent.

Examples of interfacial polymerization processes suitable for formation of the polymeric shell are illustrated in U.S. Pat. Nos. 4,000,087 and 4,307,169, the disclosures of which are totally incorporated herein by reference.

Surface additives can be selected for the toners of the present invention including, for example, metal salts, metal salts of fatty acids, colloidal silicas, mixtures thereof and the like, which additives are usually present in an amount of from about 0.01 to about 5 weight percent, reference U.S. Pat. Nos. 3,590,000; 3,720,617; 3,655,374 and 3,983,045, the disclosures of which are totally incorporated herein by reference. Preferred additives include zinc stearate AEROSIL R972®, AEROSIL R974® or AEROSIL R812®, or AEROSILS® treated with charge control agents.

Surface charge control agents or additives can be added to the toner particles by numerous methods. These components can be incorporated into the shell by the addition thereof to the surfactant or emulsifier phase, thus during interfacial polymerization of the shell the surface charge control agent is physically incorporated into the shell. This process is particularly suitable when one portion of the charge control agent is functionalized with a group such as an amine so that the charge control agent reacts as a minor aqueous shell component and is chemically incorporated into the shell. During the interfacial polymerization, the surface charge control agent diffuses toward the outer boundary of the shell and is thus located on the shell surface. Examples of surface charge control agents suitable for incorporation into the shell material include fumed or colloidal silicas such as the AEROSILS®, aluminas, talc powders, metal salts, metal salts of fatty acids such as zinc stearate, cetyl pyridinium salts, distearyl dimethyl ammonium methyl sulfate, and the like. Preferably, the charge control agent are colorless compounds so as not to interfere with the purity of color of the toners. Generally, the surface charge enhancing additives when incorporated as a component of the shell are present in an effective amount of, for example, from about 0.1 percent to about 20 percent by weight of the aqueous shell component.

Also, surface charge control agents can be blended onto the surface of the toner particles subsequent, for example, to particle formation. After particle formation and just prior to spray drying, the surface charge control agent can be added to the aqueous suspension of the washed particles, therefore during the spray drying process the charge control agent adheres to the shell surface. Surface charge control additives can also be dry blended onto the dry toner surface in a tumbling/shearing apparatus such as a Lodige blender or a Lab Master II blender manufactured by Lightnin'. Examples of surface charge control additives suitable for addition to the toner surface include fumed silicas or fumed metal oxides onto the surface of which have been deposited charge enhancing additives such as cetyl pyridinium chloride, distearyl dimethyl ammonium methyl sulfate, potassium tetraphenyl borate and the like. These surface treated silicas or metal oxides are typically treated with 5 to 25 percent of the charge enhancing agent. The surface charging agents that can be physically absorbed to the toner surface by mechanical means are generally present in an amount of from about 0.01 percent to about 15 percent by weight of the toner and preferably from about 0.1 percent to about 5 percent by weight of the toner.

In a two component development system, the custom colored encapsulated toner in about 2 to about 3 percent toner concentration, for example, can be blended with carrier to, for example, enable a triboelectric charge between the toner and carrier. The latitude of tribo is determined by, for example, the selected shell materials and the choice of carrier. Through frictional contact between the carrier and the toner, an electrostatic charge sufficient for development of an electrostatic latent image is produced on the toner and maintained at a predetermined level. Examples of suitable carriers include a carrier comprising a bare steel core of, for example, approximately 120 microns in diameter; a carrier comprising a core such as a ferrite spray coated with a thin layer of a polymeric material, 0.1 to 1 weight percent, such as a methyl terpolymer comprising about 81 percent of methyl methacrylate, about 14 percent of styrene and about 5 percent of vinyl triethoxysilane; a carrier comprising a nonround, oxidized steel shot core coated with a thin layer of a polymer comprising about 65 percent of trifluorochloroethylene and about 35 percent of vinyl chloride blended with carbon black; a carrier comprising a steel shot core coated with polyvinylidene fluoride; a carrier comprising about 35 percent by weight of polyvinylidene fluoride and about 65 percent by weight of polymethyl methacrylate; and a carrier coating comprising a ferrite core coated with a methyl terpolymer comprising about 81 percent of methyl methacrylate, about 14 percent of styrene and about 5 percent of vinyltriethoxysilane blended with carbon black. Carriers that may be employed to achieve the desired triboelectric charge on the toner are illustrated in U.S. Pat. Nos. 4,937,166 and 4,935,326, the disclosures of which are totally incorporated herein by reference.

With further reference to the present invention, formation of the toner particles by an interfacial polymerization reaction followed by a free radical polymerization of the core monomers results in toner particles having a spherical or nearly spherical toner particle morphology. The core can be polymerized subsequent to shell formation, and the viscosity of the pigmented core composition is low enough to allow the dispersion of the core in the aqueous surfactant solution during the primary particle generation step.

In addition, the shell of the microencapsulated toner prepared according to the aforementioned process has a high enough glass transition temperature, that is greater than about 60° C., in some or many embodiments of the present invention to provide adequate blocking properties and excellent mechanical properties for the resulting toner particles. Thus, there is no constraint upon the major polymer component of the toner, that is for the core polymer to have a glass transition temperature as high as 55° C. to 60° C., as is the situation with conventional melt-blended toners. Core polymerizations by free radical mechanisms may be designed to produce low melting and low energy fusing core polymers that fuse and melt at temperatures of from about −60° C. to about 60° C., which considerably widens the choice of free radical polymerizable monomers suitable for use in toner compositions of this type as compared to the choice available for toners prepared by melt blending methods.

One preferred primary toner set has tribo values measured in the known Faraday Cage blow off apparatuses with, for example, carriers comprised of steel with a polymeric overcoating of a terpolymer of methylmethacrylate, styrene, and a organovinyl triethoxy, reference U.S. Pat. Nos. 3,467,634 and 3,526,533, the disclosures of which are totally incorporated herein by reference, steel with a polymeric overcoating of polyvinylidene fluoride, and the like, of between about −100 microcoulombs per gram and −3 microcoulombs per gram, and preferably between about −25 and −10 microcoulombs per gram, or between 3 microcoulombs per gram to 100 microcouombs per gram, and preferably 10 to 25 microcoulombs per gram, respectively. A desired toner particle size range is about a volume median d50, as measured with a Coulter Multisizer, of about 2 to 30 microns, and preferably from about 3 to 15 microns. One preferred toner particle GSD (Geometric Standard Deviation) is about 1.0 to 1.7, and preferably between about 1.0 and 1.4 in embodiments of the present invention. The preferred admix times are less than 10 minutes, and preferably less than 1 minute.

When blending, there can be selected at least two encapsulated toners, and up to about 10, in ratios comprising at least 1 percent by weight of each toner, and preferably at least 5 percent of each toner. Blending may be accomplished as illustrated herein, including sequentially, masterbatching, or splitting a large blended batch into two or more portions, some of which may undergo further blending with other toners.

For two component developers, carrier particles including steel ferrites, copper zinc ferrites, and the like, with or without coatings, can be admixed with the encapsulated toners of the present invention, reference for example the carrier illustrated in U.S. Pat. Nos. 4,937,166; 4,935,326; 4,560,635; 4,298,672; 3,839,029; 3,847,604; 3,849,182; 3,914,181; 3,929,657 and 4,042,518, the disclosures of which are totally incorporated herein by reference.

The following examples are being submitted to further define various species of the present invention. These examples are intended to be illustrative only and are not intended to limit the scope of the present invention. Comparative data is also presented.

Carrier I: 0.5 percent of methyl terpolymer on Powdertech nickel zinc ferrite,

Carrier II: 1.2 percent of OXY461 ® (polyvinyl chloride-chlorotrifluoroethylene copolymer) with 7.5 percent of REGAL 330 ® carbon black on Toniolo nonround steel core, and Carrier III: 0.175 percent of KYNAR ® (polyvinylidine fluoride) on oxidized Hoeganoes grit steel.

Developers were prepared at 2 or 3 percent toner concentration (TC) by blending toner (2 or 3 grams) with carrier (98 or 97 grams) and roll milling for 15 to 30 minutes. Tribos were measured by the well known blow off process using a Faraday Cage apparatus.

Table I summarizes the tribo values of 6 conventional color toners prepared by melt blending the pigment listed, 8 weight percent with styrene butadiene resin (89/11), 92 weight percent, (Comparative Examples I through VI). The range of tribos spanned in this series is an extremely wide 85.5 μC/g against Carrier I, and 50.9 μC/g against Carrier II.

TABLE I

Tribo Values of Conventional Color Toners in Styrene Butadiene Resin, 89/11. Toner Concentration Was 3 Percent; Samples Were Roll Milled For 30 Minutes.

| Comparative Example | Pigment | Tribo [μC/g] Carrier I | Carrier II |
|---|---|---|---|
| I | Fanal Pink | +8.3 | +56.8 |
| II | None | −10.3 | +23.9 |
| III | Permanent Yellow FGL | −12.7 | +16.7 |
| IV | Hostaperm Pink E | −20.4 | +18.9 |
| V | Neopen Blue | −54.2 | +5.9 |
| VI | Sudan Blue | −77.2 | +14.3 |
| Range | | 85.5 | 50.9 |

EXAMPLE I

A 14 micron red primary encapsulated toner was prepared by the following procedure:

Into a 250 milliliter polyethylene bottle were added 52.56 grams of a styrene monomer (Polysciences Inc.), 35.04 grams of stearyl methacrylate monomer (Scientific Polymer Products), 9.07 grams of a copolymer comprising about 52 percent by weight of styrene and 48 percent by weight of n-butyl methacrylate, and 23.33 grams of a mixture of LITHOL SCARLET NBD-3755 ® pigment (BASF) flushed into a styrene/n-butyl methacrylate copolymer comprising 65 percent by weight of styrene and 35 percent by weight of n-butyl methacrylate, wherein the pigment to copolymer ratio is 45/55 by weight. The polymer and pigment were dispersed into the monomer overnight, approximately 18 hours, on a Burrell wrist shaker.

This formulation will result in a toner composition comprising 7 percent by weight of pigment, 20 percent by weight of shell and 73 percent by weight of the mixture of core monomers and polymers, which mixture was comprised of 20 percent by weight of performed polymer and 80 percent by weight of monomer. Once the pigmented monomer solution was homogeneous, into the mixture were dispersed 3.504 grams of 2,2'-azobis(2,4-dimethylvaleronitrile), Polysciences Inc., and 0.876 gram of 2,2'-azobis(2-methyl-butyronitrile), Polysciences Inc., by shaking the bottle on a Burrell wrist shaker for 10 minutes. Just prior to dispersion of the organic phase into the aqueous phase the organic shell component, 19.0 grams of meta-tetra-methylxylene diisocyanate, trade name m-TMXDI TM, (American Cyanamid Company) was added to the pigmented monomer mixture by shaking the bottle by hand. Into a stainless steel 2 liter beaker containing the aforementioned product there were added 600 milliliters of 0.75 percent TYLOSE 93800 TM, a hydroxyethyl methyl cellulose solution which was treated with a Brinkmann PT45/80 homogenizer and PTA-35/4G probe at 9,000 rpm for 1 minute. The dispersion was performed in a cold water bath at a temperature of 15° C. Subsequently, the dispersion was transferred into a 2 liter glass reactor equipped with a mechanical stirrer and an oil bath under the beaker. While stirring the solution vigorously, an aqueous solution of 11.0 grams of 2-methylpentamethylene diamine, DYTEK A TM (E.I. DuPont) in 50 milliliters of distilled water was poured into the reactor and the mixture was stirred for 2 hours at room temperature. During this time, the interfacial polymerization occurred to form a heat fusible polyurea shell around the core material. Just prior to free radical polymerization the volume was increased slightly by adding 300 milliliters of distilled water. The mixture was then heated to 80° C. for 18 hours and during this time the monomeric material polymerized via free radical polymerization. The solution was then cooled to room temperature and was washed 10 times with distilled water by settling the particles by gravity. The encapsulated toner particles were screened wet through a 150 micron sieve and then spray dried with a Yamato-Ohkawara spray dryer model DL-41. The isolated yield for the encapsulated toner product was 65.0 percent. Particle size as measured with a Coulter Multisizer instrument was 14.0 microns (volume median diameter) with a geometrical standard deviation (GSD) of 1.38.

EXAMPLES II to VII

The process of Example I was repeated and similar to Example I, additional primary encapsulated toners were prepared with various pigments loaded at the same level, reference the following table.

TABLE II

Particle Size Data for Primary Encapsulated Color Toners

| Working Example | Pigment | Pigment Source | Particle Size in Microns | GSD |
|---|---|---|---|---|
| I | Lithol Scarlet | BASF | 14.0 | 1.38 |
| II | Hostaperm Pink E | Hoechst | 14.7 | 1.36 |
| III | Heliogen Blue | BASF | 12.9 | 1.40 |
| IV | Fanal Pink | BASF | 11.9 | 1.67 |
| V | Sicofast Yellow | BASF | 8.2 | 1.33 |
| VI | Luna Yellow | BASF | 13.2 | 1.32 |
| VII | None | | 11.8 | 1.34 |

TRIBOELECTRIC PROPERTIES OF THE TONERS OF EXAMPLES I TO VII

Table III summarizes the triboelectric values of the color encapsulated toners of Examples I to VII. These toners are comprised of styrene/stearyl methacrylate cores, the pigments as listed in Table II, and 20 percent m-TMXDI TM /DYTEK A TM shells. The Heliogen Blue in Table III and Sudan Blue in Table I have the same chemical structure [Pigment Blue 15:3], thus the comparison of Heliogen Blue and Fanal Pink tribos should be a sensitive indicator of passivation. Against most of the carriers, the Heliogen Blue and Fanal Pink toners have the same tribo, although there seems to be a higher degree of uncertainty in the data for Fanal Pink, as evidenced by the variation in values against Carrier III. For a given carrier, the tribos of all single colors are the same within experimental error. The range of tribos spanned in the series is very much smaller than in the Comparative Examples: the average range of 7 μC/g is only 1/10th the average range of 68 μC/g for the comparative examples. Examination of duplicates indicates that the measurement reproducibility is of the same magnitude as the tribo range (±3–6 μC/g), thus these particles appear to be passivated.

TABLE III

Tribo Values of Primary Toners Against Three Carriers. Developers Were Conditioned 24 Hours At 50 Percent Relative Humidity, Then Roll Milled 15 Minutes

| | Tribo [μC/g] | | | | |
|---|---|---|---|---|---|
| Working Example | Carrier I 2% TC | Carrier III 2% TC (Trial 1) | Carrier III 3% TC (Trial 2) | Carrier III 2% TC (Trial 3) | Carrier II 2% TC |
| I | 1.3 | 18.3 | 14.5 | 8.5 | 23.8 |
| II | 1.5 | 12.4 | 13.9 | 8.4 | 22.8 |
| III | 2.3 | 14.3 | 15.3 | 7.7 | 20.7 |
| IV | 3.9 | 20.3 | 15.4 | 9.3 | 26.2 |
| V | 3.7 | 12.4 | 11.5 | 8.6 | 27.0 |
| VI | 5.1 | 14.6 | 10.3 | — | 15.0 |
| VII | 4.6 | 7.6 | 10.8 | 8.0 | 24.3 |
| Range | 3.8 | 12.7 | 5.1 | 1.6 | 12.0 |
| Average | 3.0 | 14.3 | 13.1 | 8.4 | 22.8 |
| Standard Deviation | 1.5 | 4.4 | 2.2 | 0.55 | 4.0 |

EXAMPLES VIII to XII

Five blended toners were prepared from the Primary Toners of Examples I to VII as follows.

A red blended toner VIII was prepared by mixing magenta primary toner IV, 1.0 gram, yellow primary toner V, 1.0 gram, and Carrier III, 98.0 grams, in a 250 milliliter glass wide mouth bottle with a tight fitting lid, and rolling on a roll mill for 15 minutes at approximately 400 rpm in an atmosphere controlled to 50 percent relative humidity.

A green blended toner IX was prepared by mixing cyan primary toner III, 25.0 grams, with yellow primary toner V, 25.0 grams, for 2 minutes at 3,000 rpm in a Lighnin' blender. A portion of this toner, 2.0 grams, was roll milled for 15 minutes with carrier III, 98.0 grams, and the tribo measured in a standard tribo blow off apparatus to be 7.6 microcoulombs per gram. Purple blended toners X and XI, and Violet blended toner XII were prepared from primary cyan toner III and primary red toner I in the manner of the red blended toner VII, as described above, while varying the weight percent of cyan primary toner III from 25 to 50 to 75 percent, respectively, and the weight percent of red primary toner from 75 to 50 to 25 percent, respectively, as shown in Table IV, together with tribo values against carrier III.

TRIBOELECTRIC PROPERTIES OF EXAMPLES VIII to XII

Table IV summarizes the carrier III tribo data of several blends of the above encapsulated toners having different colors. Both the individual toners and the blended toners have tribos comparable to those reported in Table III for carrier III with a similar range and standard deviation. The blended toners were observed to have a single distribution in the charge spectrograph smears. This is also consistent with passivation of triboelectric properties of the pigment by the encapsulating shell.

TABLE IV

Tribo Values of Blended Color Toners Against Carrier III at 50 Percent Relative Humidity. Toner Concentration Was 2 Percent; Developers Were Roll Milled 15 Minutes.

| Example | Composition | Tribo/μC/g |
|---|---|---|
| Red Primary Toner I | | 15.1 |
| Cyan Primary Toner III | | 8.1 |
| Magenta Primary Toner IV | | 17.9 |

TABLE IV-continued

Tribo Values of Blended Color Toners Against Carrier III at 50 Percent Relative Humidity. Toner Concentration Was 2 Percent; Developers Were Roll Milled 15 Minutes.

| Example | Composition | Tribo/μC/g |
|---|---|---|
| Yellow Primary Toner V | | 9.1 |
| Red Blended Toner VIII | 50% Toner IV + 50% Toner V | 10.7 |
| Green Blended Toner IX | 50% Toner III + 50% Toner V | 7.6 |
| Purple Blended Toner X | 25% Toner III + 75% Toner I | 8.9 |
| Purple Blended Toner XI | 50% Toner III + 50% Toner I | 7.0 |
| Violet Blended Toner XII | 75% Toner III + 25% Toner I | 6.9 |
| Average | | 10.1 |
| Range | | 11.0 |
| Standard Deviation | | 3.9 |

Other modifications of the present invention may occur to those skilled in the art subsequent to a review of the present application, and these modifications, including equivalents thereof, are intended to be included within the scope of the present invention.

What is claimed is:

1. A process for obtaining custom color toner compositions which comprises admixing at least two encapsulated toners wherein each toner is comprised of a core comprised of a polymer binder, pigment, dye, or mixtures thereof, and a polymeric shell prepared by interfacial polycondensation polymerization; and wherein the pigment, dye or mixtures thereof is different for each toner, thereby resulting in a custom color toner with a color different than each of said encapsulated toners, and containing an effective proportion of intact polymeric shells which results in the triboelectric charge on the custom color toner being substantially equal to the triboelectric charge on the encapsulated toners.

2. A process in accordance with claim 1 wherein there are selected from about 2 to about 10 encapsulated toners.

3. A process in accordance with claim 2 wherein two passivated encapsulated toners are selected and the first toner is comprised of a core comprised of a polymer, and a cyan, yellow, or magenta pigment, and the second toner is comprised of a core comprised of a polymer, and a cyan, yellow, or magenta pigment; and wherein the pigment for the second toner is dissimilar to the pigment for the first toner.

4. A process in accordance with claim 3 wherein the pigment for the first toner is cyan, and the pigment for the second toner is magenta.

5. A process in accordance with claim 3 wherein the pigment for the first toner is magenta, and the pigment for the second toner is yellow.

6. A process in accordance with claim 3 wherein the pigment for the first toner is cyan, and the pigment for the second toner is yellow.

7. A process in accordance with claim 3 wherein the pigment for the first toner is yellow present in an amount of from about 60 to about 10 weight percent, and the pigment for the second toner is magenta present in an amount of from about 40 to about 90 weight percent.

8. A process in accordance with claim 7 wherein there results a red toner.

9. A process in accordance with claim 3 wherein the pigment for the first toner is yellow present in an amount of from about 95 to about 60 weight percent, and the pigment for the second toner is magenta present in an amount of from about 5 to about 40 weight percent.

10. A process in accordance with claim 3 wherein the pigment for the first toner is yellow, and the pigment for the second toner is cyan thereby providing a green toner.

11. A process in accordance with claim 3 wherein the pigment for the first toner is cyan, and the pigment for the second toner is magenta thereby providing a blue toner.

12. A process in accordance with claim 1 wherein the pigment for one toner is yellow, the pigment for a second toner is magenta, and the pigment for a third toner is cyan thereby providing a brown toner.

13. A process in accordance with claim 1 wherein the pigment for a first toner is a yellow pigment selected from the group consisting of Pigment Yellow GFL, Sicofast Yellow, Luna Yellow, and Pigment Yellow 17; the pigment for a second toner is a cyan selected from the group consisting of Pigment Blue 15:3 (copper phthalocyanine), Neopen Blue, PV Fast Blue, Heliogen Blue, and anthraquinione blue; and the pigment for a third toner is a magenta pigment selected from the group consisting of rhodamines, quinacridones, and Fanal Pink.

14. A process in accordance with claim 1 wherein the shell is comprised of the reaction product of a diisocyanate and diamine, or a polyisocyanate and an amine.

15. A process in accordance with claim 14 wherein the polyisocyanate is selected from the group consisting of benzene diisocyanate, toluene diisocyanate, diphenylmethane diisocyanate, 1,6-hexamethylene diisocyanate, bis(4-isocyanatocyclohexyl)methane, and polyether isocyanate prepolymers.

16. A process in accordance with claim 14 wherein the amine is methylpentamethylene diamine.

17. A process in accordance with claim 1 wherein the core binder is an acrylate polymer, a methacrylate polymer, or a styrene polymer.

18. A process in accordance with claim 1 wherein the core binder is an acrylate polymer, a methacrylate polymer, or a styrene polymer.

19. A process in accordance with claim 1 wherein the core binder is a poly(styrene-co-stearyl methacrylate).

20. A process in accordance with claim 1 wherein the core binder is derived from polymerization of addition monomers selected from the group consisting of methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, and substituted styrenes.

21. A process in accordance with claim 2 wherein the pigment for one toner is carbon black, magnetite, or mixtures thereof.

22. A process in accordance with claim 2 wherein the pigment for a first encapsulated toner is cyan, yellow, magenta, red, green, blue, brown or mixtures thereof.

23. A process in accordance with claim 22 wherein the pigment for a second toner is carbon black, magnetite, or mixtures thereof.

24. A process in accordance with claim 2 wherein the pigment for a first toner or a second toner is Heliogen Blue, Pylam Oil Blue, Pylam Oil Yellow, Pigment Blue 1, Pigment Violet 1, Pigment Red, Lemon Chrome Yellow, E.D. Toluidine Red, Bon Red C, Novaperm Yellow FGL, Hostaperm Pink E, Cinquasia Magenta, Oil Red anthraquinone dye, Cl Dispersed Red 15, diazo dye, Cl Solvent Red 19, copper tetra-4-(octadecyl sulfonamido) phthalocyanine, X-copper phthalocyanine pigment, Cl Pigment Blue, Anthrathrene Blue, diarylide yellow 3,3-dichlorobenzidene acetoacetanilides, Cl Solvent Yellow, a nitrophenyl amine sulfonamide, Cl Dispersed Yellow 33, 2,5-dimethoxy-4-sulfonanilide phenylazo-4'-chloro-2,5-dimethoxy acetoacetanilide, or Permanent Yellow FGL; and wherein the pigment for the first and second toner are unequivalent.

25. A process in accordance with claim 2 wherein the toners contain surface additives.

26. A process in accordance with claim 1 wherein the polymeric shell is selected from the group consisting of a polyester, a polyurea, or a polyurethane.

27. A process for preparing passivated custom color toner compositions which comprises (1) preparing a first core material which comprises first pigment particles and core monomer and optional polymer components, and preparing a second core material which comprises second pigment particles and core monomer and optional polymer components, said second pigment particles being of a different color from that of the first pigment particles; (2) dispersing the core materials into an aqueous phase containing a surfactant or emulsifier; (3) encapsulating said first core material and said second core material within polymeric shells by interfacial polymerization reactions between at least two shell monomers, wherein the first shell monomer is soluble in organic media and the second shell monomer is soluble in aqueous media; (4) polymerizing the core monomers via free radical polymerization at a temperature of from about 50° C. to about 130° C. for about 8 hours to about 24 hours; (5) thereafter washing the toner thus formed to remove the stabilizing materials; (6) subsequently drying the final toner product, thereby producing two encapsulated heat fusible toner compositions of different colors and having similar triboelectric charging characteristics; and (7) admixing the formed two encapsulated toners thereby resulting in a custom color toner with a color different than each of said encapsulated toners, and containing an effective proportion of intact polymeric shells which results in the triboelectric charge on the custom color toner being substantially equal to the triboelectric charge on the encapsulated toners.

28. A process for the preparation of developer compositions which comprises admixing the toner compositions of claim 1 with carrier particles.

29. A process in accordance with claim 28 wherein the carrier particles are comprised of a core with a polymeric coating.

30. A process in accordance with claim 28 wherein the carrier particles are selected from the group consisting of a ferrite core spray coated with a thin layer of a methyl terepolymer comprising 81 percent of methyl methacrylate, 14 percent of styrene and 5 percent of vinyl triethoxysilane; a nonround, oxidized steel shot core coated with a thin layer of a polymer comprising 65 percent of trifluorochloroethylene and 35 percent of vinyl chloride blended with carbon black; a steel shot core coated with polyvinylidene fluoride; a steel shot core coated with a polymer of 35 percent by weight of polyvinylidene fluoride and 65 percent by weight of polymethylmethacrylate; a ferrite core coated with a methyl terepolymer comprising 81 percent of methyl methacrylate, 14 percent of styrene and 5 percent of vinyltriethoxysilane blended with carbon black and mixtures thereof.

31. A process in accordance with claim 1 wherein a surface charge control agent is incorporated into said polymeric shells.

32. A process in accordance with claim 31 wherein the surface charge control agent is selected from the group consisting of fumed or colloidal silicas, aluminas, talc powders, metal salts, metal salts of fatty acids, alkylpyridinium salts, distearyl dimethyl ammonium methyl sulfate and mixtures thereof.

* * * * *